US005390619A

United States Patent [19]

Miller

[11] Patent Number: 5,390,619

[45] Date of Patent: Feb. 21, 1995

[54] WATER EXPANDED COMPRESSED SPONGE CABLE FAIRING

[75] Inventor: Howard A. Miller, Encinitas, Calif.

[73] Assignee: The United States of America as represented by the Secretary of the Navy, Washington, D.C.

[21] Appl. No.: 115,965

[22] Filed: Aug. 25, 1993

[51] Int. Cl.[6] ..... F15D 1/10

[52] U.S. Cl. ..... 114/243

[58] Field of Search ..... 114/242–245, 114/253, 254; 244/130

[56] References Cited

U.S. PATENT DOCUMENTS 3,227,398 1/1966 Struble, Jr. ..... 114/243

OTHER PUBLICATIONS

Flexnose® "A New Concept In Cable Fairing for Oceanographers" Jun. 1970.

*Primary Examiner*—Edwin L. Swinehart

*Attorney, Agent, or Firm*—Harvey Fendelman; Thomas Glenn Keough

[57] ABSTRACT

A cable fairing preferably for an underwater cable is formed from regenerated cellulose sponge material. The fairing is attached to the cable while the material is in an expanded and dehydrated state. Once hydrated, the fairing may be compressed from a flexible state to a compacted state for storage of the cable. The fairing assumes its original streamline shape when again deployed in water.

14 Claims, 2 Drawing Sheets

WATER EXPANDED COMPRESSED SPONGE CABLE FAIRING

STATEMENT OF GOVERNMENT INTEREST

The invention described herein may be manufactured and used by or for the Government of the United States for governmental purposes without the payment of any royalties thereon or therefor.

FIELD OF THE INVENTION

The present invention relates to the field of fairings for underwater cables, and more particularly to a water expanded compressed sponge cable fairing that stores compactly on a standard storage drum.

BACKGROUND OF THE INVENTION

Underwater cables that are either suspended in or towed through the water require fairings in order to reduce cable strum and/or the drag force on the cable. Current underwater cable fairings are typically rigid streamlined foils or flexible grass.

The rigid streamlined foils provide good strum and drag reduction but are extremely bulky and difficult to store on a drum. Oftentimes, these cables can only be wound about a storage drum in one layer because of their bulk and interference by adjacent fairings on the drum. Thus, special handling equipment such as large drums are required to protect the fairings. Further, even if the fairings are made from a material having some degree of resiliency (e.g., plastic or rubber), storage on a drum often induces a permanent set associated with material creep stress relaxation. Then, when deployed, these fairings are unable to return to their intended shape which can result in hydrodynamic flow induced kiting of the cable. The current alternative to the use of rigid (or semi-rigid) foils is a flexible grass-like fairing. However, while being easy to store on a drum, these fairings have only successfully reduced strum at the expense of drag reduction.

Thus, there is a need in the underwater cable art for a cable fairing that reduces strum and drag, and a cable fairing that can be stored compactly on a standard storage drum without causing any permanent damage to the fairing's hydrodynamic flow characteristics. Accordingly, it is an object of the present invention to provide a fairing for an underwater cable that satisfies both deployed performance and storage criteria. Another object of the present invention is to provide a fairing for an underwater cable that may be fitted to existing cables. Yet another object of the present invention is to provide a fairing for an underwater cable that is inexpensive.

SUMMARY OF THE INVENTION

In accordance with the present invention, a fairing for an underwater cable is formed from regenerated cellulose sponge material. The fairing is adhered to the cable while the material is semi-rigid in its expanded and dehydrated state. The fairing includes a main body portion and an appendage portion extending from the main body portion. The main body portion and the appendage portion achieve a flexible state when deployed in water with the appendage portion being adapted for streaming underwater. The main body portion and the appendage portion may be compressed while in the flexible state to a compacted state for storage of the cable. In the compacted state, the main body portion and the appendage portion are conformable.

The advantages of the present invention are numerous. The regenerated cellulose sponge material fairing may be compressed in accordance with a variety of compact winding configurations. Thus, storage volume of the wound cable is minimized. In addition, the compacted regenerated cellulose sponge fairing readily returns to its original fairing shape when deployed underwater.

DESCRIPTION OF THE DRAWINGS

FIGS. 2A, 2B and 2C are cross-section sequences showing one method of storing the cable and fairing of the present invention;

DESCRIPTION OF THE PREFERRED EMBODIMENT

Figure 1:
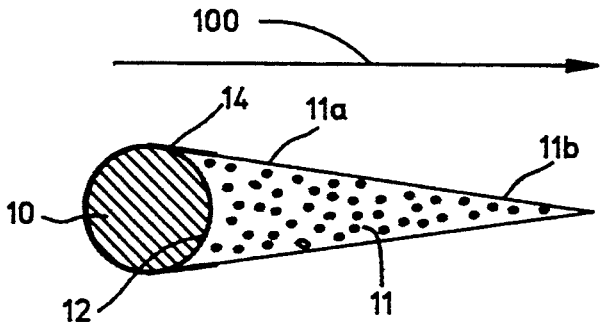
FIG. 1 is a cross-section of a cable and cable fairing according to the present invention.

Referring now to the drawings, and more particularly to FIG. 1, a cross-section of cable 10 (e.g., an underwater cable) is shown with its cable fairing 11 attached thereto in accordance with the present invention. Fairing 11 is constructed from a regenerated cellulose sponge material. The choice of a particular regenerated cellulose sponge material will depend on the application. However, in the preferred embodiment, a sponge material with the finest cell structure available is used to provide smooth exterior surfaces. This minimizes turbulence and drag at the surface of the fairing to yield the best strum reduction characteristics. Currently, one such commercially available regenerated cellulose sponge material is F-12 manufactured by 3M, Inc. However, it is to be understood that as advances are made in cell size reduction, even finer cell structures will become available and are to be considered suitable for use in the present invention.

Fairing 11 has a main body portion 11*a* attached to cable 10 preferably by means of an adhesive 12 and/or tape 14 while the sponge material is semi-rigid in its expanded and dehydrated state. Examples of a suitable adhesive include urethane based adhesives from Synthetic Surfaces Inc. (No. 34D-2) and Upaco Adhesives, Division of Worthen Industries (No. 2400). An appendage portion 11*b* of fairing 11 extends away from cable 10 as a fin in a direction opposite the direction of movement of cable 10 as referred to generally by flow arrow 100. However, it is to be understood that the size and shape of fairing 11 may be other than as shown without departing from the scope of the present invention. For example, fairing 11 may be a simple straight fin as shown or may be shaped (e.g., curved, angled with respect to flow arrow 100, etc.) to provide curvilinear or angular streaming characteristics. Further, fairing 11 may be a continuous fairing along the length of cable 10 or may comprise multiple fairings provided along the length of cable 10 (not shown).

Figure 2A:
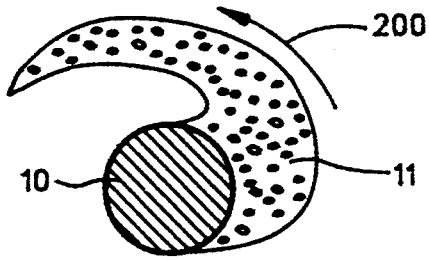
FIG. 2A is a cross-section view of a single continuous cable fairing attached to a portion of a cable.
Figure 2B:
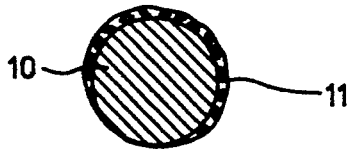
Figure 2C:
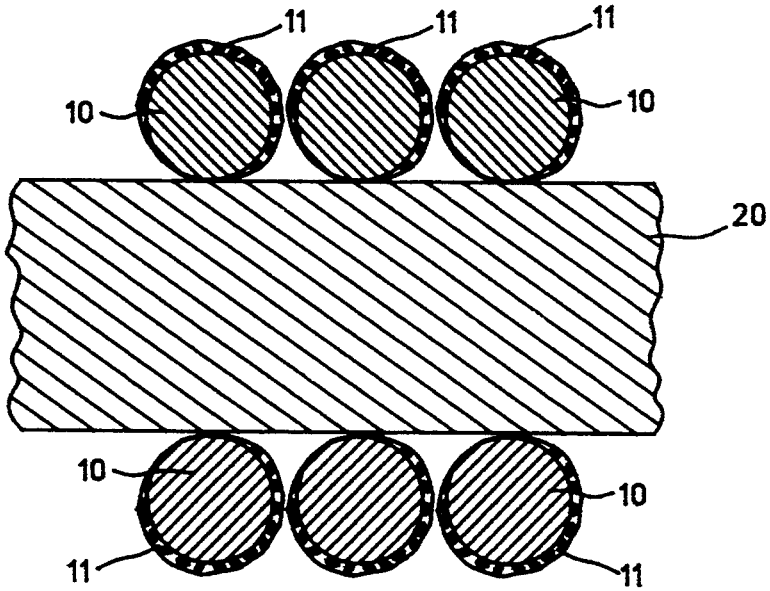
Figure 3:
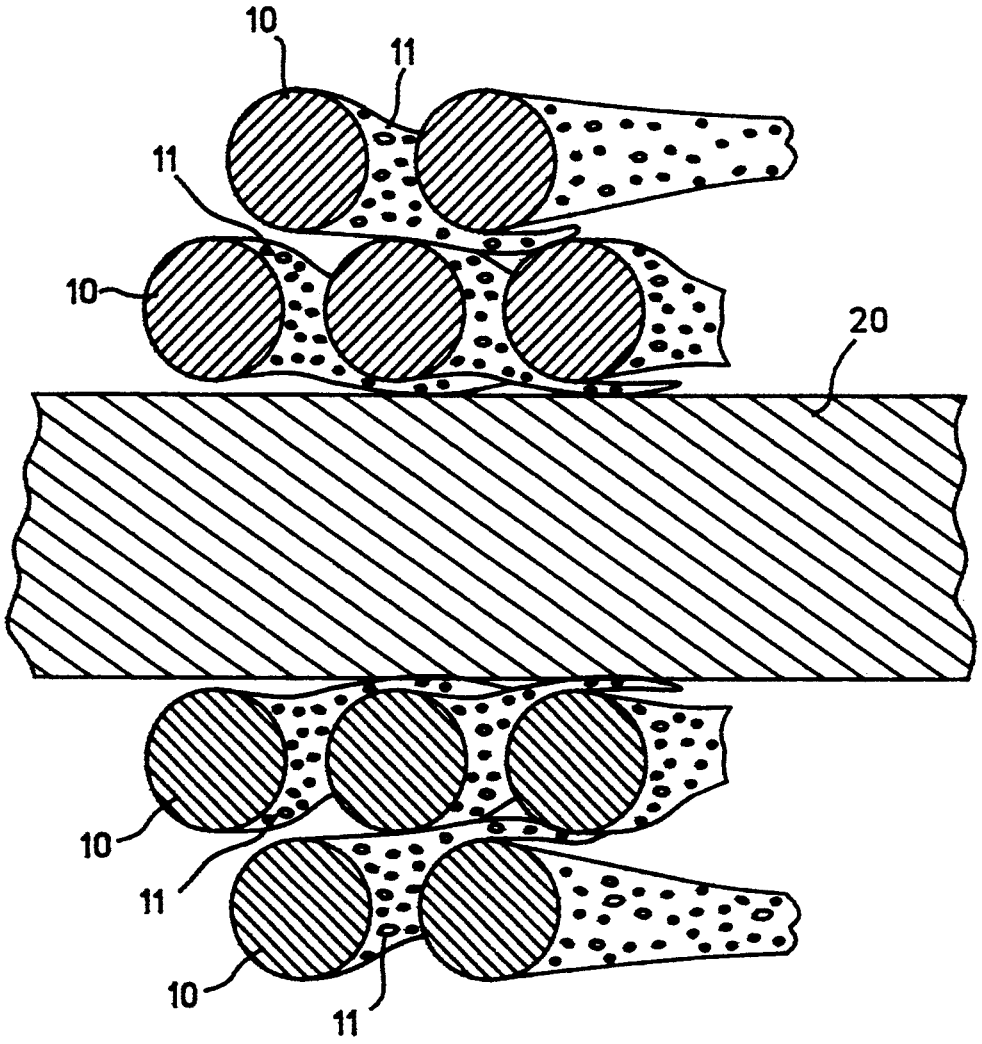
FIG 3 is a cross-section of an alternative storage configuration for the cable and fairing of the present invention.

Once adhered to cable 10, fairing 11 is momentarily saturated with water, liquid containing water, or other liquid to soften the sponge material. Cable 10 with fairing 11 may now be stored in a variety of ways. For example, as shown in the cross-section of FIGS. 2A, 2B and 2C, softened fairing 11 may be wrapped about cable 10 as indicated by arrow 200 in FIG. 2A and then compressed as shown in FIG. 3B. Fairing 11 may be temporarily held in the compressed state of FIG. 2B by means of a porous band or tape (not shown) wrapped around fairing 11. Fairing 11 is then dried in the wrapped and compressed state shown in FIG. 2B at which time the porous band is removed and the cable is wound onto a storage drum. The wound configuration is shown maintained on a storage drum 20 as shown in cross-section in FIG. 2C.

Alternatively, cable 10 with softened fairing 11 may be wound directly onto a storage drum. In this case, softened fairing 11 is allowed to assume a natural position during the winding process. As adjacent turns of cable 10 are laid down, softened fairing 11 is compressed by cable 10. One such resulting wound configuration on storage drum 20 might resemble that shown in FIG. 3. Fairing 11 would then be allowed to dry in position on storage drum 20.

In either case, since compressed regenerated cellulose sponge material does not undergo storage induced permanent set, fairing 11 will return to its original hydrodynamic shape when cable 10 is next deployed underwater. Further, the sponge material absorbs water quickly thereby allowing it to assume its streamlined shape shortly after deployment.

Figure 4:
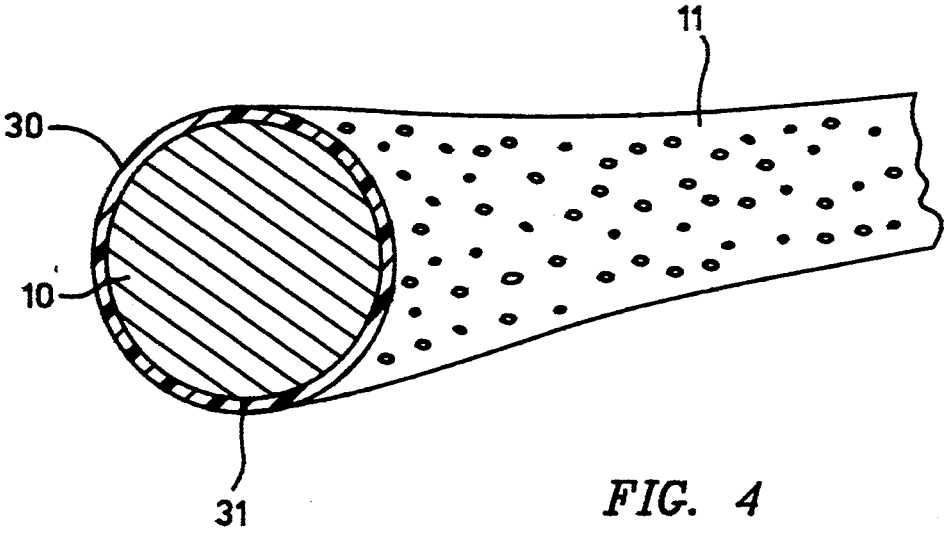
FIG. 4 a cross-section of the cable and fairing showing an alternative method of securing the fairing of the present invention to the cable.

Although the invention has been described relative to a specific embodiment thereof, there are numerous variations and modifications that will be readily apparent to those skilled in the art in light of the above teachings. For example, as shown in FIG. 4, fairing 11 might first be bonded to a clip 30 which would then snap over cable 10. In this way, the fairing could be easily attached in the field to existing cables. Clip 30 may be a thin-walled tube split along its length as indicated at reference numeral 31. Clip 30 is made from a material such as a thermoplastic polyester or cellulose acetate. Clip 30 is simply opened along split 31 to receive cable 10. Clip 30 is then released to snap back and enclose cable 10 as shown. Multiple clips would be required for either continuous or multiple fairings. The length of each clip and the gap between adjacent clips would be selected based on the cable's diameter and the bend radius required during handling and use. It is therefore to be understood that, within the scope of the appended claims, the invention may be practiced other than as specifically described.

What is claimed as new and desired to be secured by Letters Patent of the United States is:

1. A cable fairing, comprising:

regenerated cellulose sponge material for attachment to a cable;

said regenerated cellulose sponge material including a main body portion and an appendage portion extending from said main body portion;

said main body portion and said appendage portion achieving a flexible state when deployed in liquid, said appendage portion being shaped for streaming when in a liquid; and said main body portion and said appendage portion compressing while in said flexible state to a compacted state for storage of said cable, wherein said main body portion and said appendage portion are conformable in said compacted state.

2. A cable fairing as in claim 1 wherein said regenerated cellulose sponge material is adapted to be attached in an expanded and dehydrated state to a portion of a cable.

3. A cable fairing as in claim 1 wherein said appendage portion includes at least one fin extending opposite the direction of motion of said cable.

4. A cable fairing as in claim 1 wherein said appendage portion includes at least one tapered fin.

5. A cable fairing as in claim 2 wherein said main body portion and said appendage portion are adapted to wrap around a cable in said compacted state.

6. A fairing as in claim 2 wherein, during said storage of said cable, said cable is adapted to be wound about a drum to form adjacent windings of said cable, and wherein said adjacent windings of said cable cause said main body portion and said appendage portion to compress into said compacted state.

7. A fairing as in claim 2 wherein said regenerated cellulose sponge material is adapted to be adhered directly to a portion of a cable when said regenerated cellulose sponge material is in said expanded and dehydrated state.

8. A fairing as in claim 2 further comprising a split-tube, wherein said regenerated cellulose sponge material is adhered directly to a portion of the outside surface of said split-tube when said regenerated cellulose sponge material is in said expanded and dehydrated state, wherein said split-tube is fitted over said portion of said cable.

9. A cable fairing as in claim 8 wherein said split-tube is made from a material selected from the group consisting generally of thermoplastic polyester and cellulose acetate.

10. A cable fairing comprising regenerated cellulose sponge material in the shape of a fairing having a leading and trailing edge, and having a curved surface at said leading edge for conformal attachment to a cable.

11. A cable fairing as in claim 10 wherein said regenerated cellulose sponge material is adapted to be attached in an expanded and dehydrated state to a portion of a cable.

12. A fairing as in claim 11 wherein said regenerated cellulose sponge material is adapted to be adhered directly to said portion of a cable when said regenerated cellulose sponge material is in said expanded and dehydrated state.

13. A fairing as in claim 11 further comprising a split-tube, wherein said regenerated cellulose sponge material is adhered directly to a portion of the outside surface of said split-tube when said regenerated cellulose sponge material is in said expanded and dehydrated state, wherein said split-tube is fitted over said portion of said cable.

14. A cable fairing as in claim 11 wherein said split-tube is made from a material selected from the group consisting generally of thermoplastic polyester and cellulose acetate.

* * * * *